US009032568B2

(12) United States Patent
Roney

(10) Patent No.: US 9,032,568 B2
(45) Date of Patent: May 19, 2015

(54) DRAINABLE HAMMOCK

(71) Applicant: Hatteras Hammocks, Inc., Greenville, NC (US)

(72) Inventor: Reid Roney, Greenville, NC (US)

(73) Assignee: HATTERAS HAMMOCKS, INC., Greenville, NC (US)

( * ) Notice: Subject to any disclaimer, the term of this patent is extended or adjusted under 35 U.S.C. 154(b) by 0 days.

(21) Appl. No.: 13/861,752

(22) Filed: Apr. 12, 2013

(65) Prior Publication Data

US 2013/0269104 A1 Oct. 17, 2013

Related U.S. Application Data

(60) Provisional application No. 61/623,258, filed on Apr. 12, 2012.

(51) Int. Cl.
*A45F 3/22* (2006.01)
*A45F 3/24* (2006.01)

(52) U.S. Cl.
CPC .... *A45F 3/24* (2013.01); *A45F 3/22* (2013.01)

(58) Field of Classification Search
CPC ..... A45F 3/22; A45F 3/24; A47C 3/0255; A61G 7/0005
USPC ..... 5/120–126, 606; D6/387
See application file for complete search history.

(56) References Cited

U.S. PATENT DOCUMENTS

| | | | | | |
|---|---|---|---|---|---|
| 633,111 | A * | 9/1899 | Bartlett | 5/89.1 |
| 646,657 | A * | 4/1900 | Melton | 5/618 |
| 1,158,356 | A * | 10/1915 | Wilson | 135/97 |
| 2,378,202 | A * | 6/1945 | Dillon | 5/122 |
| 4,062,586 | A * | 12/1977 | Ortize | 297/248 |
| 4,192,024 | A * | 3/1980 | Zigmont | 4/496 |
| 4,471,794 | A * | 9/1984 | Kirkham, Jr. | 135/95 |
| 5,038,428 | A * | 8/1991 | Shur | 5/122 |
| 5,271,107 | A * | 12/1993 | Gof et al. | 4/572.1 |
| 5,729,845 | A * | 3/1998 | Hsu | 5/120 |
| 5,911,193 | A * | 6/1999 | Johnson | 119/28.5 |
| 6,360,383 | B1 * | 3/2002 | Tseng | 5/129 |
| 6,665,896 | B1 * | 12/2003 | Tseng | 5/121 |
| 7,073,464 | B2 * | 7/2006 | Keil | 119/753 |
| 7,788,745 | B1 * | 9/2010 | Beaton | 5/120 |
| 2004/0154098 | A1 * | 8/2004 | Bhatt | 5/122 |
| 2007/0022531 | A1 * | 2/2007 | Lyons | 5/122 |
| 2007/0079442 | A1 * | 4/2007 | Stoll | 5/120 |

* cited by examiner

*Primary Examiner* — Nicholas Polito
*Assistant Examiner* — Eric Kurilla
(74) *Attorney, Agent, or Firm* — Ward and Smith, P.A.

(57) ABSTRACT

Drainable hammocks with an arrangement of drainage paths in the fabric of the hammock bed are disclosed, wherein the drainage paths are openings in the fabric of the hammock bed. In one example, the openings are formed by grommets that are positioned in the fabric of the hammock bed. A method of operation of the drainable hammocks includes, but is not limited to, the steps of water impinging the uppermost surface of the hammock bed, water flowing due to gravity from the high points in the hammock bed to the low points in the hammock bed, and water exiting the hammock bed through the drainage paths and onto the ground below.

11 Claims, 11 Drawing Sheets

DRAINABLE HAMMOCK

RELATED APPLICATIONS

This patent application is related to and claims priority to U.S. Provisional Patent Application No. 61/623,258, filed on Apr. 12, 2012, entitled "Tufted Drainable Hammock" the entire disclosure of which is incorporated herein by reference.

TECHNICAL FIELD

The presently disclosed subject matter relates generally to the structure of a hammock and more particularly to drainable hammocks with an arrangement of drainage paths in the fabric so that water can drain from the hammock bed, wherein the drainable hammock may be tufted or not tufted.

BACKGROUND

Hammocks are a popular item of outdoor furniture because they are inexpensive, readily mobile, breezy, and comfortably accommodating. One problem inherent to hammocks that are made from a solid piece of fabric is that rain water can accumulate on the hammock. The user then either has to manually remove the water from the hammock or wait for the water to evaporate from the hammock. Consequently, new approaches are needed that reduce, or entirely eliminate, the accumulation of water on the surface of hammocks.

SUMMARY

In one embodiment a drainable hammock is provided. The drainable hammock may include a hammock bed; and one or more drainage paths arranged in the hammock bed, wherein the one or more drainage paths comprise openings through material of the hammock bed, wherein the openings allow fluid to flow therethrough. The hammock bed may be substantially flat. The one or more drainage paths may be arranged in a random or non-random configuration. The one or more drainage paths may be circular, oval, square, rectangular, polygonal, and/or triangular shape. The one or more drainage paths may be formed by one or more grommets in the material of the hammock bed. The hammock bed may include tufts. The drainage paths and one or more grommets may be configured to form the tufts in the hammock bed, and the material of the hammock bed may be raised in between the one or more grommets. The hammock bed may be formed using two layers of material including a cushioning material therebetween. The tufts may be formed via the two layers of material being configured to substantially come together at the one or more grommets to form thin portions of the hammock bed and moving away from the one or more grommets the cushioning material arranged between the two layers of material may be configured to form thicker portions of the hammock bed. The drainage paths may be formed by channels leading from the thicker portions of the hammock bed to the thinner portions of the hammock bed, wherein a flow of fluid is directed toward the one or more grommets comprising openings, the openings providing a fluid path out of hammock bed. The drainable hammock may further include reinforcing material around at least a portion of the one or more grommets. The reinforcing material may include stitching. The hammock bed may be supported at least partially by one or more sets of clews, one or more spreader bars, and one or more clew rings. The one or more sets of clews may include cords, ropes, or the like for suspending the hammock bed. The clews may pass through one of channels, openings, holes, or the like in the one or more spreader bars and are preferably secured to the one or more clew rings. A set of clews, spreader bar, and clew ring may be positioned at opposite ends of the hammock bed and attached to one or more supporting structures suitable for holding the drainable hammock in a suspended fashion. The one or more supporting structures may include one or more of trees, poles, buildings, a freestanding frame, any other suitable structure, or any combinations thereof. The drainable hammock may further include a pillow disposed thereon.

BRIEF DESCRIPTION OF THE DRAWINGS

Figure 1:
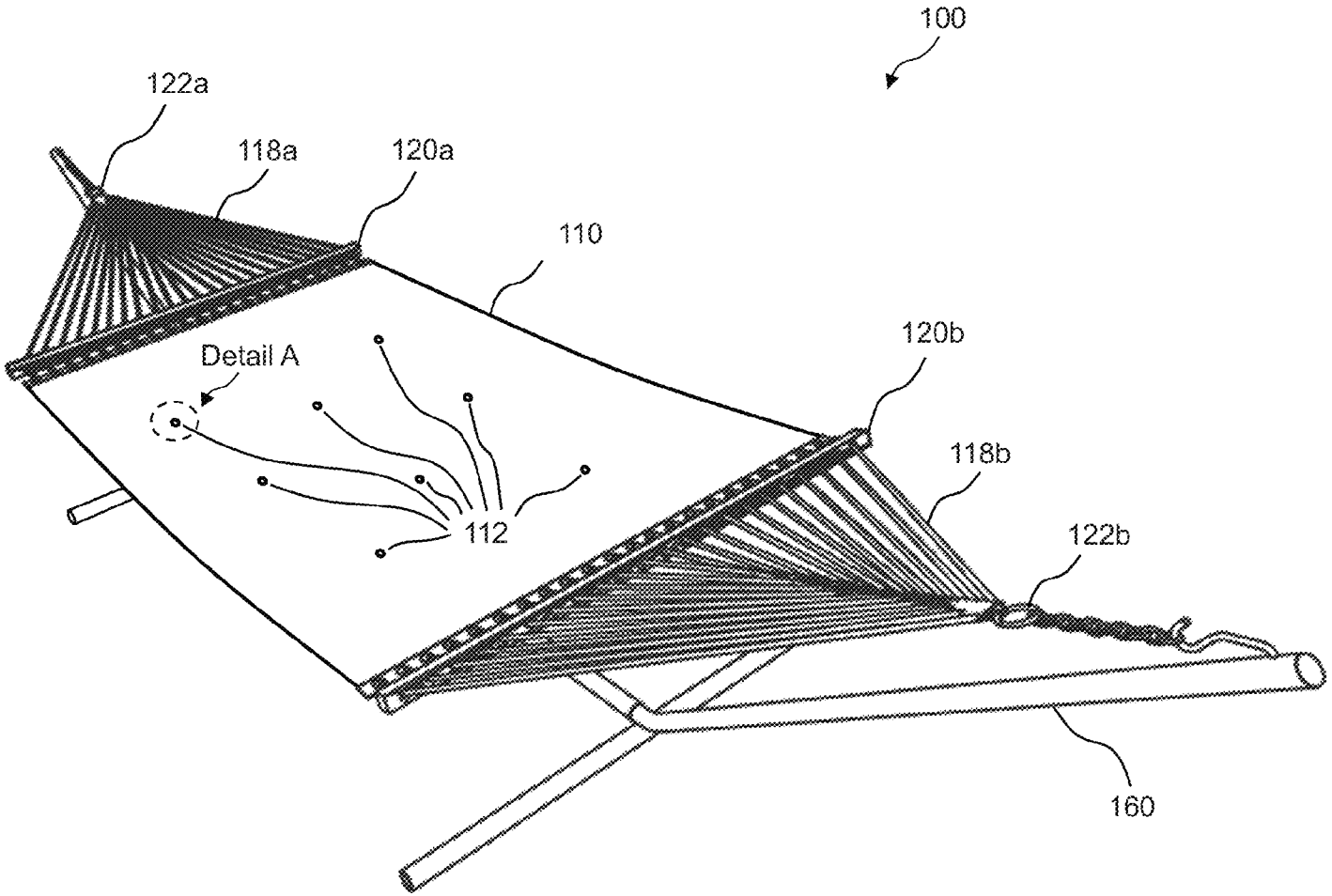
Figure 2:
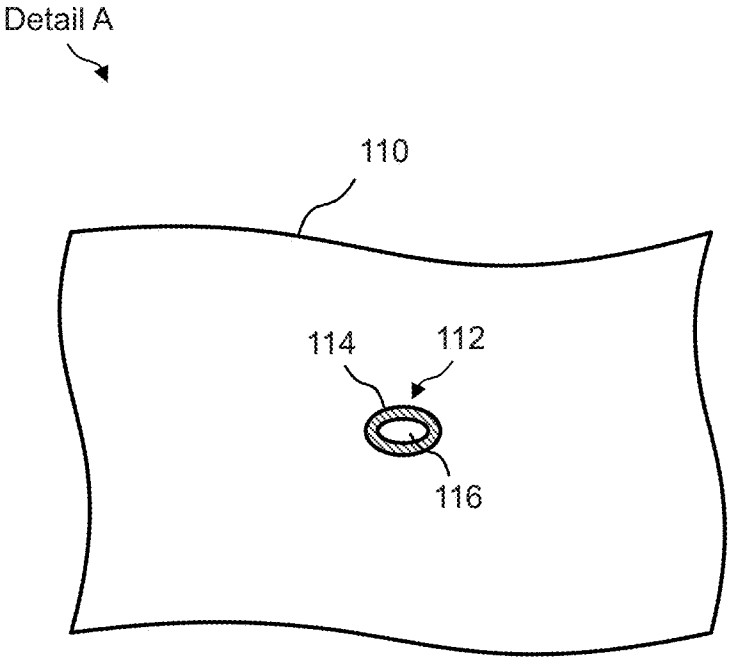
Figure 3:
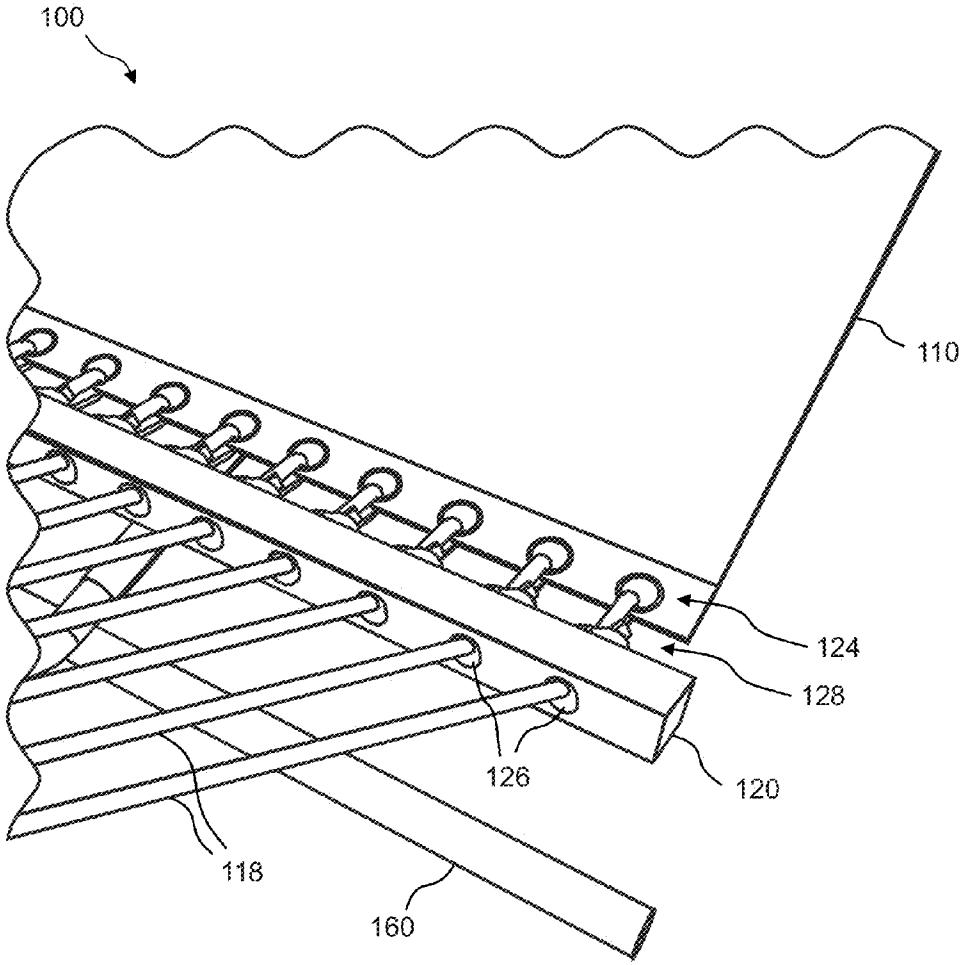
Figure 4:
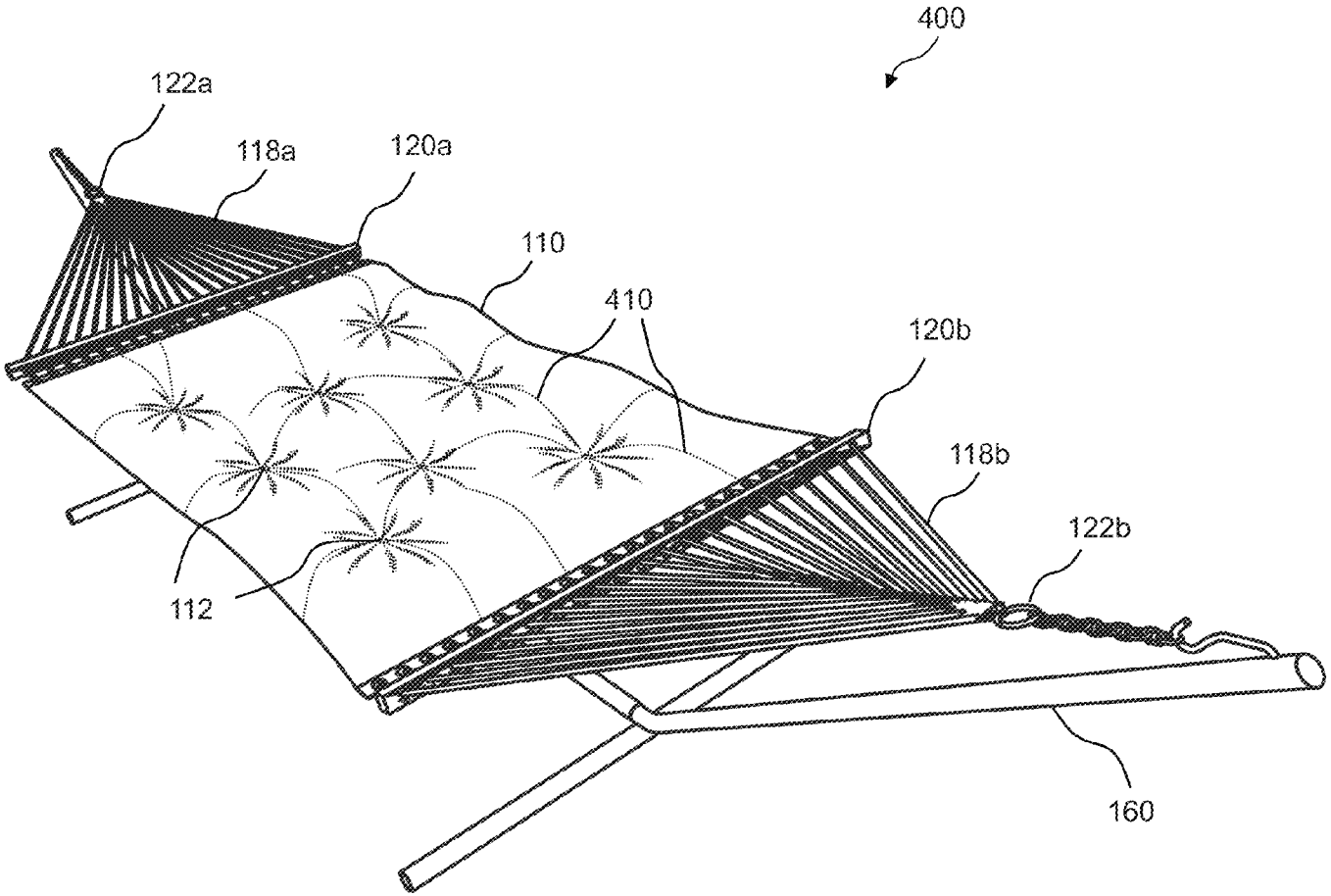
Figure 5:
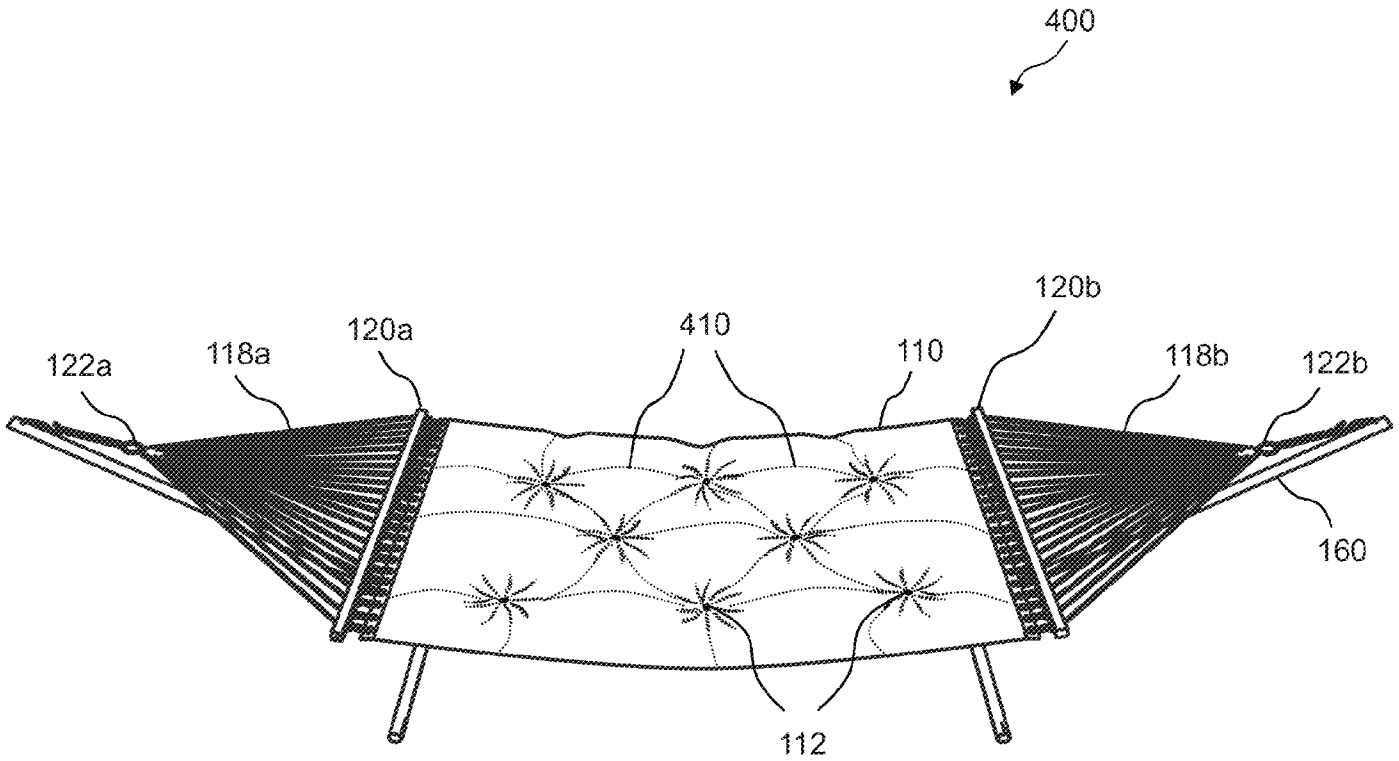
Figure 6:
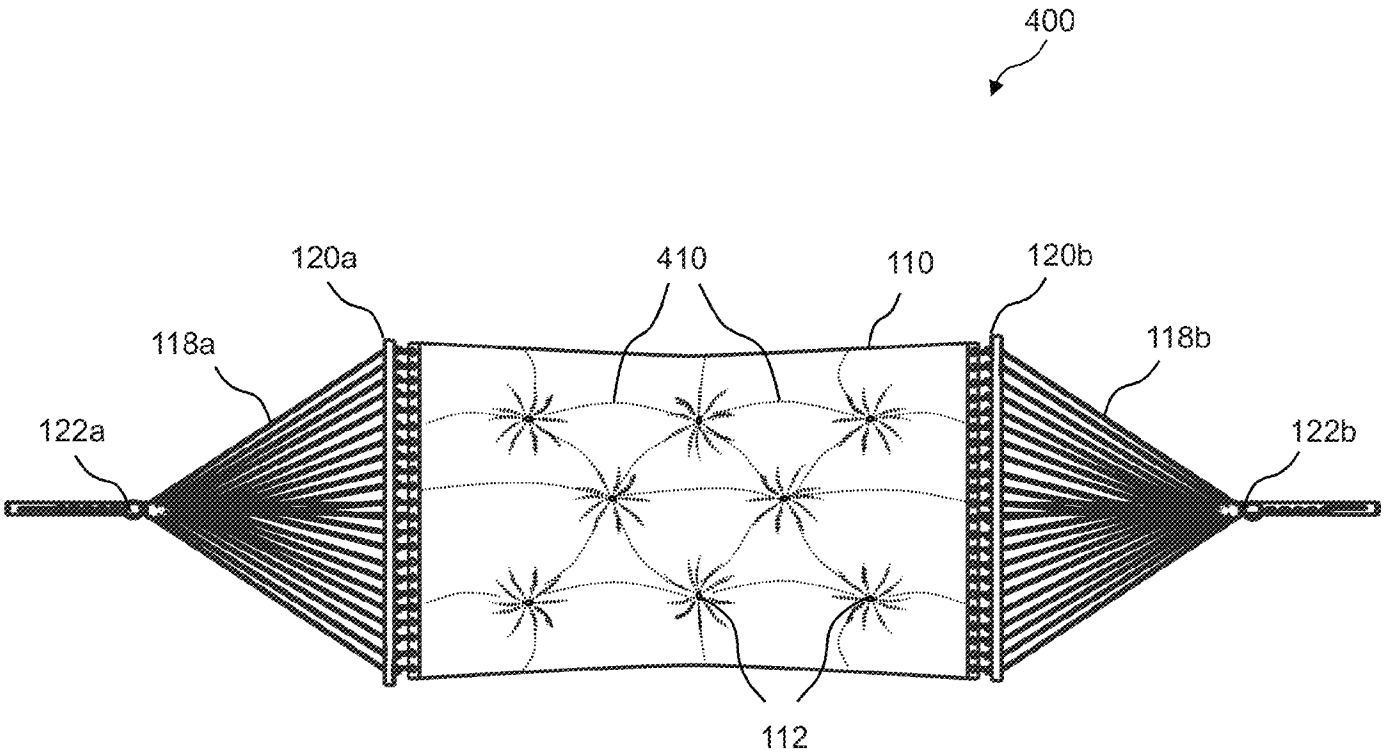
Figure 7:
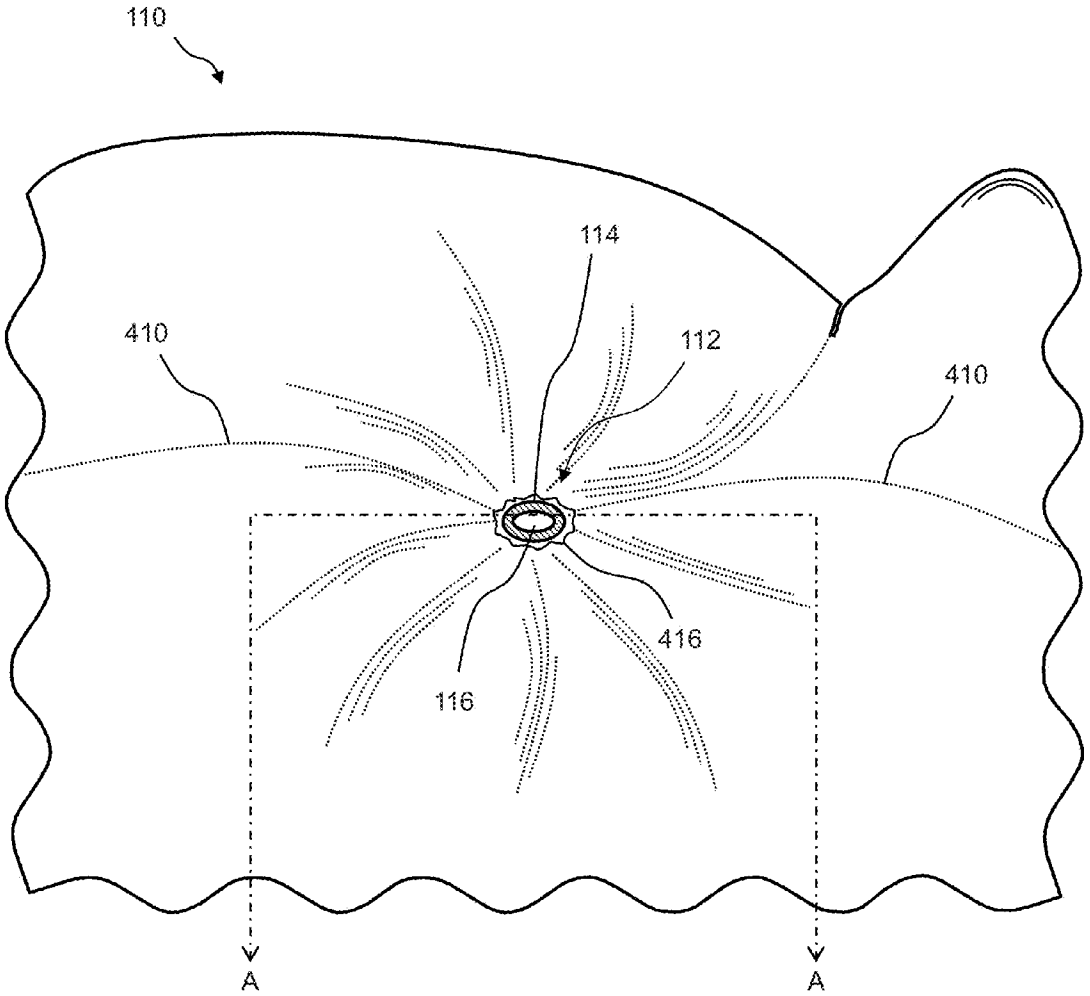
Figure 8:
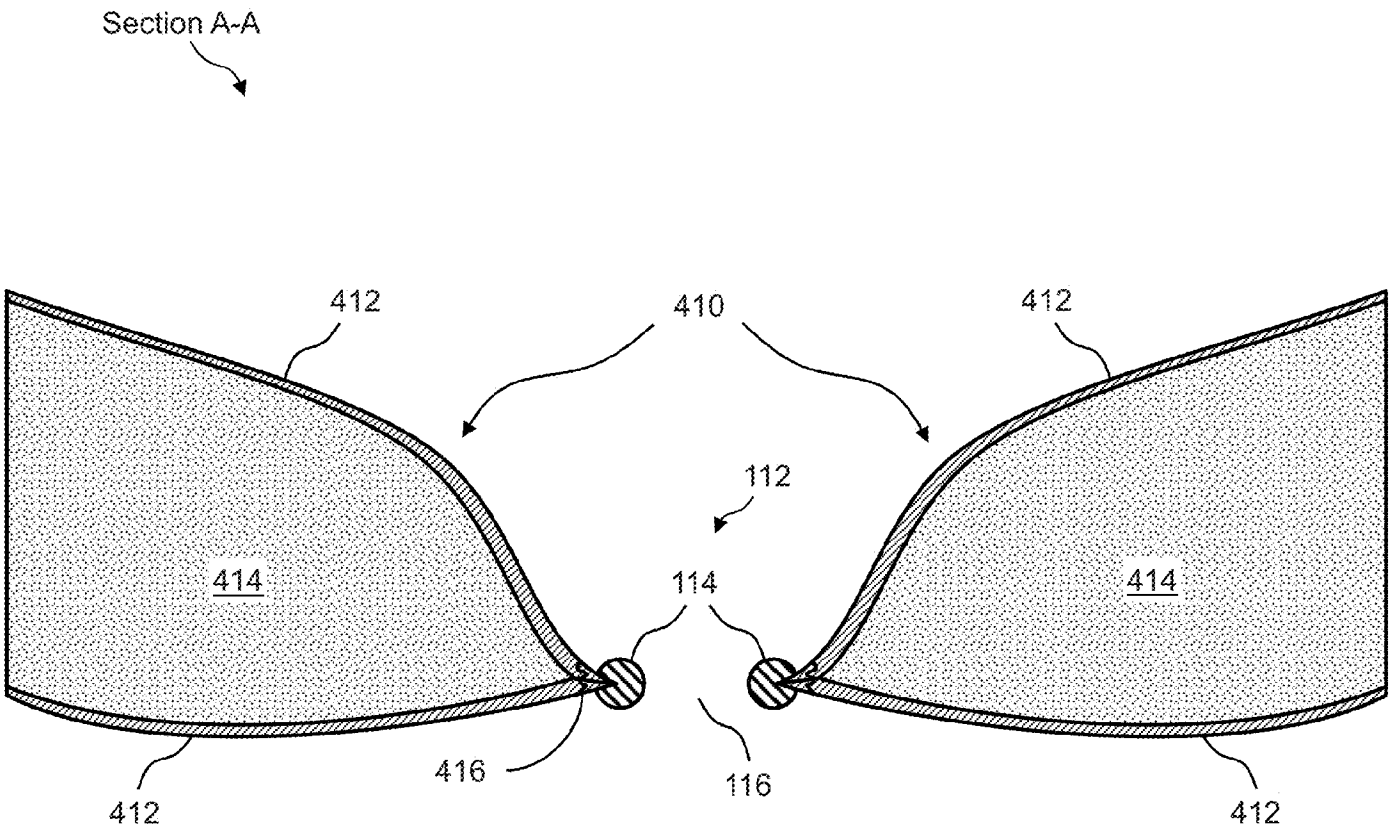
Figure 9:
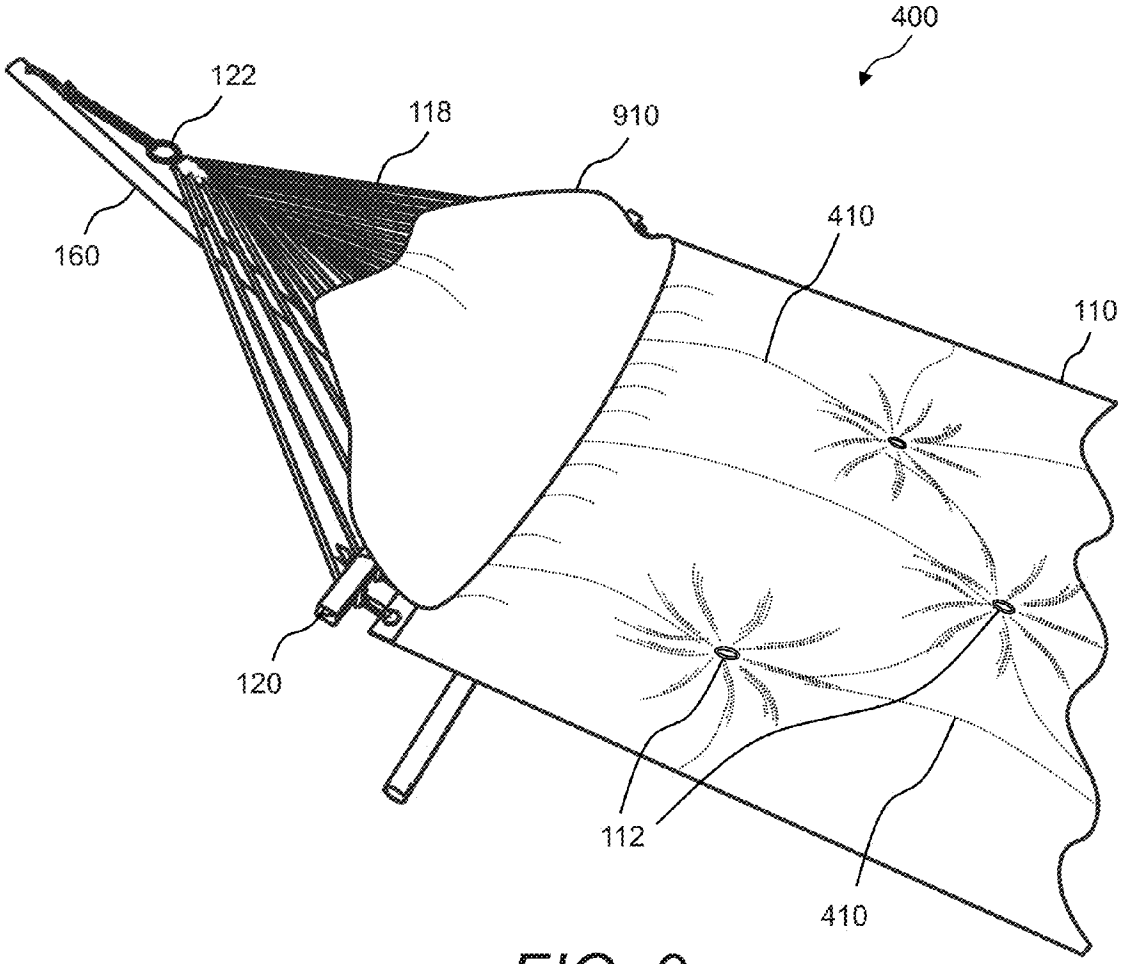
Figure 10:
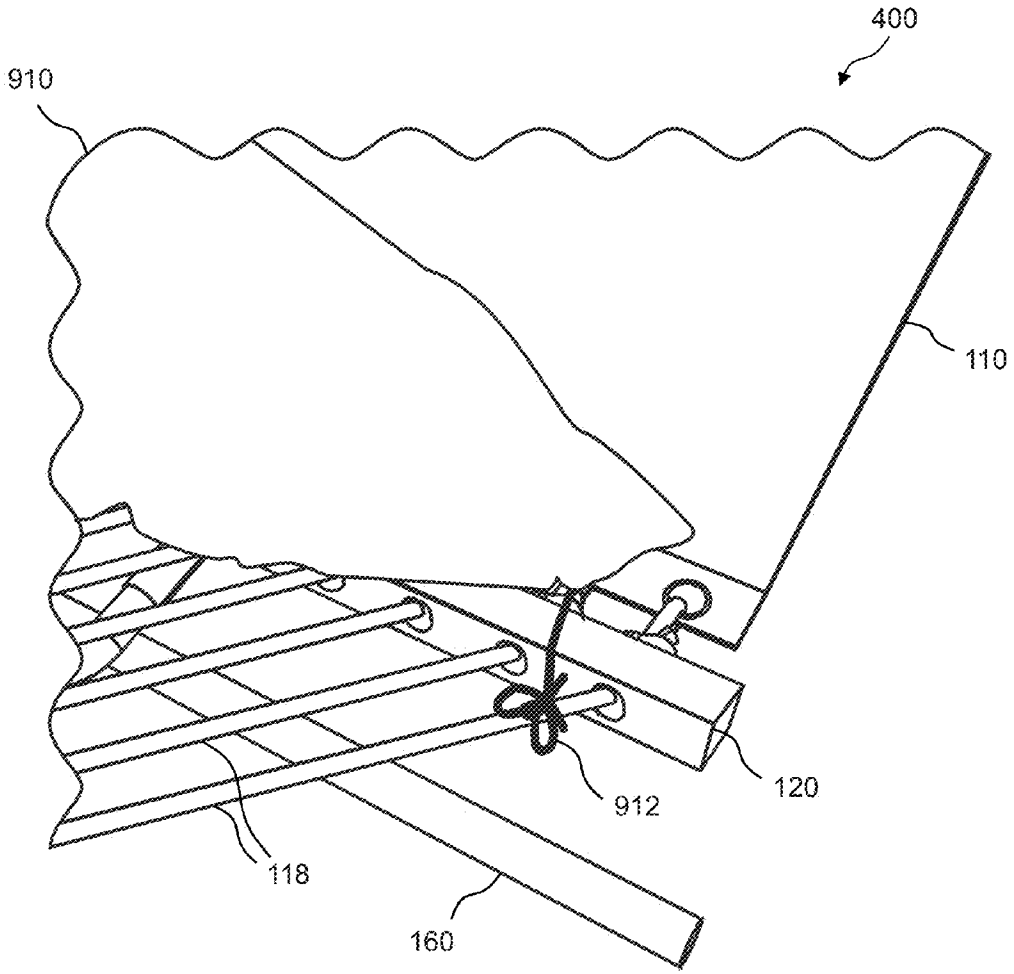

Having thus described the presently disclosed subject matter in general terms, reference will now be made to the accompanying Drawings, which are not necessarily drawn to scale, and wherein:

FIG. 1 illustrates a perspective view of an example of a drainable hammock that is not tufted, according to one embodiment of the invention;

FIG. 2 shows more details of the grommets that provide drainage paths in the hammock bed of the drainable hammock of FIG. 1;

FIG. 3 illustrates a cutaway view showing more details of the clews attaching to the hammock bed of the drainable hammock of FIG. 1;

FIG. 4 and FIG. 5 illustrate perspective views of an example of a drainable hammock that is tufted, according to another embodiment of the invention;

FIG. 6 illustrates a top down view of the tufted drainable hammock of FIG. 4 and FIG. 5;

FIG. 7 illustrates a top down view of a portion of the tufted drainable hammock, showing more details of one drainage path thereof;

FIG. 8 illustrates a cross-sectional view of the tufted drainable hammock, taken along line AA of FIG. 7;

FIG. 9 illustrates a perspective view of a portion of the drainable hammock, showing a pillow attached thereto; and FIG. 10 illustrates a cutaway view showing more details of the pillow attached to the drainable hammock.

Figure 11:
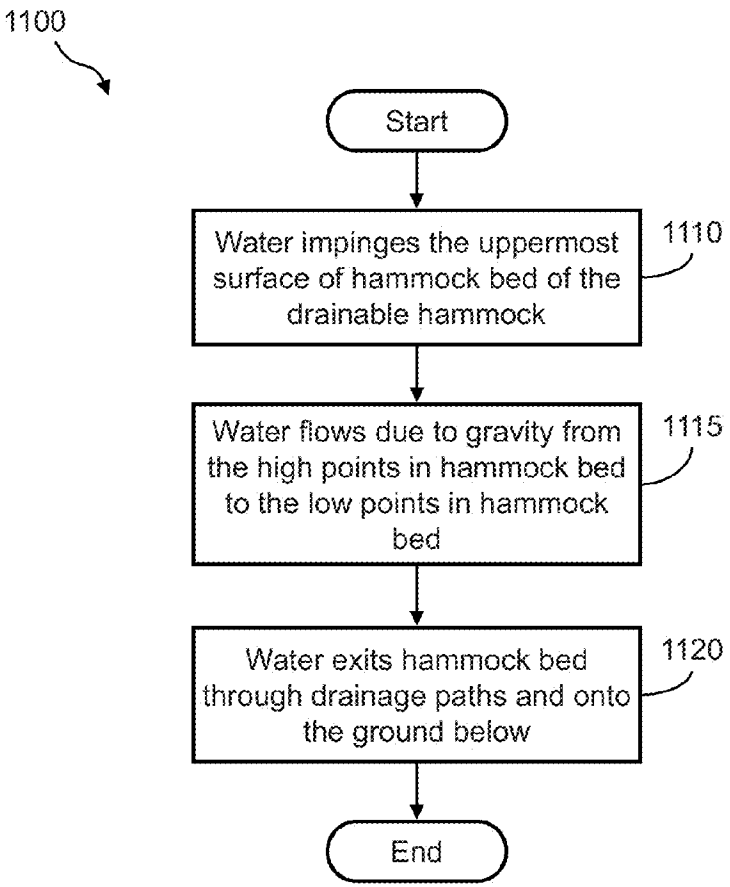

FIG. 11 illustrates a flow diagram of an example of a method of operation of the presently disclosed drainable hammocks.

DETAILED DESCRIPTION

The presently disclosed subject matter now will be described more fully hereinafter with reference to the accompanying Drawings, in which some, but not all embodiments of the presently disclosed subject matter are shown. Like numbers refer to like elements throughout. The presently disclosed subject matter may be embodied in many different forms and should not be construed as limited to the embodiments set forth herein; rather, these embodiments are provided so that this disclosure will satisfy applicable legal requirements. Indeed, many modifications and other embodiments of the presently disclosed subject matter set forth herein will come to mind to one skilled in the art to which the presently disclosed subject matter pertains having the benefit of the teachings presented in the foregoing descriptions and the associated Drawings. Therefore, it is to be understood that the presently disclosed subject matter is not to be limited to the specific embodiments disclosed and that modifications and other embodiments are intended to be included within the scope of the appended claims.

In some embodiments, the presently disclosed subject matter provides drainable hammocks with an arrangement of drainage paths in the material of the hammock bed. The drainage paths allow fluid, such as water, to drain from the hammock bed. For example, the drainable hammock has openings that are arranged at the low points in the hammock bed, which allows water, such as rain water, to drain from the hammock bed and onto the ground below. In one example, the openings are formed by grommets, or grommet like structures, that are positioned in the fabric of the hammock bed.

In one embodiment, the hammock bed of the drainable hammock is substantially flat (i.e., not tufted). However, in another embodiment, the hammock bed of the drainable hammock is tufted. Namely, the grommets that form the openings may allow the fabric to become tufted so that portions of the hammock bed rise higher than other portions. For example, the hammock bed can include two layers of fabric with cushioning material therebetween. This allows water to drain from the hammock bed by flowing into and through the openings more easily than if the hammock bed is relatively flat (i.e., not tufted). That is, because of the tufts, drainage paths or channels are formed that direct the flow of water toward the grommets, wherein the openings in the grommets provide a fluid path out of the hammock bed.

Therefore, an aspect of the drainable hammocks disclosed herein is that they reduce, or substantially eliminate, the accumulation of water on the surface of the hammock bed as compared with conventional hammocks. Accordingly, the drainable hammock exhibit numerous advantages over conventional hammocks that include a solid piece of fabric on which rain water can accumulate.

FIG. 1 illustrates a perspective view of a drainable hammock 100 according to one embodiment of the invention, which is an example of a drainable hammock that is not tufted. In this example, drainable hammock 100 includes a substantially flat hammock bed that is drainable. For example, drainable hammock 100 includes a hammock bed 110 that can be formed of any fabric or combination of fabrics that is suitably strong for supporting a certain amount of weight, such as that as one or more people (e.g., in the range of about 400 lbs., or potentially more or less) and suitably durable for withstanding outdoor use. Examples of materials from which hammock bed 110 may be made include, but are not limited to, cloth, nylon, canvas, vinyl, plastic, rubber, and any combinations thereof. Further, the length and width of hammock bed 110 is preferably suitable to accommodate at least one individual, and may include sizes to accommodate multiple individuals.

An arrangement of multiple drainage paths 112 is provided in the fabric of hammock bed 110, wherein the drainage paths 112 are distributed over the area of hammock bed 110 in any configuration. The drainage paths 112 are openings in the fabric of hammock bed 110 that allow water to flow therethrough. The shape of drainage paths 112 may be circular, oval, square, rectangular, polygonal, triangular, or any other suitable shape. The multiple drainage paths 112 can be arranged in hammock bed 110 in any kind of random or nonrandom pattern. For example, multiple drainage paths 112 can be arranged in a grid pattern or a staggered grid pattern.

Referring now to FIG. 2, a Detail A is shown of an example of one drainage path 112 that provides a fluid path in hammock bed 110 through which water can flow out of drainable hammock 100 and onto the ground below. In one example, FIG. 2 shows that drainage path 112 is formed by installing a grommet (or grommet like structure) 114 in the fabric of hammock bed 110. The grommet 114 has an opening 116 that provides a fluid path out of the hammock bed 110. For example, because there is a natural sag (due to gravity) in hammock bed 110, water (e.g., rain water) will flow to the low points of hammock bed 110 and through the openings 116 in grommets 114 and onto the ground below.

Referring now again to FIG. 1, drainable hammock 100 may further include two sets of clews 118 (e.g., clews 118*a* and 118*b*), a pair of spreader bars 120 (e.g., spreader bars 120*a* and 120*b*), and a pair of clew rings 122 (e.g., clew rings 122*a* and 122*b*); all supporting hammock bed 110. More specifically, at one end, drainable hammock 100 may include a set of clews 118*a* that are affixed to one end of hammock bed 110. Clews, such as clews 118, are the cords, ropes, or the like by which a hammock is suspended. Clews 118*a* preferably pass through channels, openings, holes, or the like in spreader bar 120*a* and then preferably terminate at clew ring 122*a*. In like manner, at the other end, drainable hammock 100 may include a set of clews 118*b* that are preferably affixed to the other end of hammock bed 110. Clews 118*b* preferably pass through channels, openings, holes, or the like in spreader bar 120*b* and preferably terminate at clew ring 122*b*. More details of clews 118 and spreader bars 120 are shown and described with respect to FIG. 3.

Clew rings 122*a* and 122*b*, which are at opposite ends of hammock bed 110 of drainable hammock 100, may be attached to any supporting structure that is suitable for holding drainable hammock 100 in a suspended fashion. In one example, using clew rings 122*a* and 122*b*, drainable hammock 100 may be suspended between two trees, two poles, two buildings, or any combinations thereof. In another example, which is shown in FIG. 1, using clew rings 122*a* and 122*b*, drainable hammock 100 may be suspended between two supports of a freestanding, portable frame 160.

FIG. 3 illustrates a cutaway view of a portion of drainable hammock 100, showing more details of clews 118 attaching to hammock bed 110 of drainable hammock 100. Namely, FIG. 3 shows a line of grommets (or grommet like structures) 124 installed along the edge of the end of hammock bed 110 and a corresponding line of openings 126 in spreader bar 120, wherein each of the grommets 124 and each of the openings 126 preferably corresponds to a particular clew 118. Namely, the clews 118 pass through their corresponding openings 116 in spreader bar 120. Then, the ends of the clews 118 pass through their corresponding grommets 124 and may be tied off in knots 128, as shown, or otherwise secured.

FIG. 4, FIG. 5, and FIG. 6 illustrate various views of a drainable hammock 400 according to another embodiment of the invention, wherein drainable hammock 400 is an example of a tufted drainable hammock. Namely, FIG. 4 and FIG. 5 illustrate perspective views of drainable hammock 400 and FIG. 6 illustrates a top down view of drainable hammock 400.

Drainable hammock 400 is substantially the same as drainable hammock 100 of FIG. 1 except that hammock bed 110 is tufted instead of substantially flat. More specifically, the presence of drainage paths 112, which include grommets 114, allow the formation of tufts 410 in hammock bed 110 such that the fabric of hammock bed 110 is raised in between the grommets 114. FIG. 7 and FIG. 8 show an embodiment of the presently disclosed drainable hammock 400 in which the grommets 114 can be seen forming tufts 410 in hammock bed 110.

FIG. 7 illustrates a top down view of a portion of drainable hammock 400 showing more details of one drainage path 112 and tufts 410, while FIG. 8 illustrates a cross-sectional view of drainable hammock 400 taken along line A-A of FIG. 7. Referring now to FIG. 7 and FIG. 8, tufts 410 are formed around each grommet 114 of each drainage path 112. Namely, hammock bed 110 of drainable hammock 400 may be formed using two layers of fabric 412 that have cushioning material 414 therebetween.

However, the thickness of cushioning material 414 varies and therefore the contour of hammock bed 110 varies. For example, the two layers of fabric 412 come together at grommet 114, the grommets having a thickness T, to form the thinnest portions of hammock bed 110. However, moving away from grommet 114, cushioning material 414 may become thicker and thicker to form the thicker portions of hammock bed 110, i.e., to form tufts 410 having a thickness greater than, at least, 2T. In this way, parts of hammock bed 110 rise higher than other parts, wherein drainage paths 112 are formed by the channels leading from the thick portions of hammock bed 110 to the thin portions of hammock bed 110, which are at grommets 114. Because of tufts 410, drainage paths 112 are formed that direct the flow of water toward the grommets 114, wherein openings 116 in grommets 114 provide a fluid path out of hammock bed 100. That is, the thin portions of tufts 410 at each of the grommets 114 provide natural low points in tufts 410 to which water, such as rain water, will flow and then exit hammock bed 110 through openings 116. In some embodiments, the openings 116 (i.e. drainage holes) encompass no more than 5% of the surface area of the sheet material of the hammock.

Optionally, stitching 416 can be provided around each of the grommets 114 for further reinforcement. Stitching 416 can be around the entirety of each of the grommets 114 or around only a portion of each of the grommets 114. The presence of stitching 416 may decrease the likelihood of fabric 412 pulling away over time from grommets 114.

Optionally, the presently disclosed drainable hammock 100 and drainable hammock 400 may include a pillow, or pillow like structure, as shown in FIG. 9 and FIG. 10. For example, FIG. 9 shows a pillow 910 at one end of drainable hammock 400. In one example, pillow 910 may be secured to clews 118 via ties 912, or the like, as shown in FIG. 10. Pillow 910 may be formed, for example, of the same type of fabrics and/or cushioning material that is used to form tufts 410 in hammock bed 110 of drainable hammock 400, or other such suitable fabrics and/or cushioning material.

FIG. 11 illustrates a flow diagram of an example of a method 1100 of operation of the presently disclosed drainable hammock 100 and drainable hammock 400. Method 1100 may include, but is not limited to, the following steps.

At a step 1110, water, such as rain water, impinges the uppermost surface of hammock bed 110 of drainable hammock 100 or drainable hammock 400.

At a step 1115, the water flows due to gravity from the high points in the fabric of hammock bed 110 to the low points in the fabric of hammock bed 110. For example, in the case of drainable hammock 100 that has a substantially flat hammock bed 110, because there is a natural sag (due to gravity) in hammock bed 110, water (e.g., rain water) will flow to the low points of hammock bed 110.

In the case of drainable hammock 400 that has tufts 410, parts of hammock bed 110 rise higher than other parts, wherein drainage paths 112 are formed by the channels leading from the thick portions of hammock bed 110 to the thin portions of hammock bed 110, which are at grommets 114. Because of tufts 410, drainage paths 112 are formed that direct the flow of water toward the grommets 114, wherein openings 116 in grommets 114 provide a fluid path out of hammock bed 100. That is, the thin portions of tufts 410 at each of the grommets 114 provide natural low points in tufts 410 to which water, such as rain water, will flow.

At a step 1120, the water exits hammock bed 110 through the openings 116 in grommets 114 of drainage paths 112 and onto the ground below.

In summary, the features of the presently disclosed drainable hammock 100 and drainable hammock 400 and method 1100 reduce, or entirely eliminate, the accumulation of water on the surface of the hammock beds as compared with conventional hammocks that include of solid piece of fabric on which rain water can accumulate.

Following long-standing patent law convention, the terms "a," "an," and "the" refer to "one or more" when used in this application, including the claims. Thus, for example, reference to "a subject" includes a plurality of subjects, unless the context clearly is to the contrary (e.g., a plurality of subjects), and so forth.

Throughout this specification and the claims, the terms "comprise," "comprises," and "comprising" are used in a non-exclusive sense, except where the context requires otherwise. Likewise, the term "include" and its grammatical variants are intended to be non-limiting, such that recitation of items in a list is not to the exclusion of other like items that can be substituted or added to the listed items.

For the purposes of this specification and appended claims, unless otherwise indicated, all numbers expressing amounts, sizes, dimensions, proportions, shapes, formulations, parameters, percentages, parameters, quantities, characteristics, and other numerical values used in the specification and claims, are to be understood as being modified in all instances by the term "about" even though the term "about" may not expressly appear with the value, amount or range. Accordingly, unless indicated to the contrary, the numerical parameters set forth in the following specification and attached claims are not and need not be exact, but may be approximate and/or larger or smaller as desired, reflecting tolerances, conversion factors, rounding off, measurement error and the like, and other factors known to those of skill in the art depending on the desired properties sought to be obtained by the presently disclosed subject matter. For example, the term "about," when referring to a value can be meant to encompass variations of, in some embodiments, ±100% in some embodiments ±50%, in some embodiments ±20%, in some embodiments ±10%, in some embodiments ±5%, in some embodiments ±1%, in some embodiments ±0.5%, and in some embodiments ±0.1% from the specified amount, as such variations are appropriate to perform the disclosed methods or employ the disclosed compositions.

Further, the term "about" when used in connection with one or more numbers or numerical ranges, should be understood to refer to all such numbers, including all numbers in a range and modifies that range by extending the boundaries above and below the numerical values set forth. The recitation of numerical ranges by endpoints includes all numbers, e.g., whole integers, including fractions thereof, subsumed within that range (for example, the recitation of 1 to 5 includes 1, 2, 3, 4, and 5, as well as fractions thereof, e.g., 1.5, 2.25, 3.75, 4.1, and the like) and any range within that range.

Although the foregoing subject matter has been described in some detail by way of illustration and example for purposes of clarity of understanding, it will be understood by those skilled in the art that certain changes and modifications can be practiced within the scope of the appended claims.

That which is claimed:

1. A drainable hammock, comprising:

a. a hammock bed formed using two layers of sheet material and further comprising a cushioning material therebetween; and b. one or more drainage paths arranged in the hammock bed comprising channels and drainage holes;

wherein the drainage holes comprise openings through the material of the hammock bed formed by one or more grommets having a thickness T in the material of the hammock bed, wherein the openings allow fluid to flow therethrough, and wherein the one or more grommets are configured to form tufts in the hammock bed, wherein the tufts are formed via the two layers of sheet material being configured to substantially come together at the one or more grommets to form thin portions of the hammock bed, and moving away from the one or more grommets the cushioning material arranged between the two layers of material is configured to form thicker portions of the hammock bed, thereby forming the channels running from the thicker portions to the thin portions, the thicker portions having a thickness greater than 2T;

and further wherein the drainage holes comprise no more than 5% of a surface area of the material of the hammock bed, thereby maintaining adequate material area to facilitate the thicker portions having a thickness greater than 2T.

2. The drainable hammock of claim 1 wherein the one or more drainage paths are arranged in a random configuration.

3. The drainable hammock of claim 1 wherein the one or more drainage paths are arranged in a non-random configuration.

4. The drainable hammock of claim 1 wherein the one or more drainage holes comprise a circular, oval, square, rectangular, polygonal, and/or triangular shape.

5. The drainable hammock of claim 1 further comprising reinforcing material around at least a portion of the one or more grommets.

6. The drainable hammock of claim 5 wherein the reinforcing material comprises stitching.

7. The drainable hammock of claim 1 wherein the hammock bed is supported at least partially by one or more sets of clews, one or more spreader bars, and one or more clew rings.

8. The drainable hammock of claim 7 wherein the one or more sets of clews comprise cords or ropes for suspending the hammock bed.

9. The drainable hammock of claim 7 wherein the clews pass through one of channels, openings, and holes in the one or more spreader bars and are secured to the one or more clew rings.

10. The drainable hammock of claim 7 wherein a set of clews, a spreader bar, and a clew ring are positioned at opposite ends of the hammock bed and attached to one or more supporting structures suitable for holding the drainable hammock in a suspended fashion.

11. The drainable hammock of claim 1 further comprising a pillow disposed thereon.

* * * * *